US006368261B1

(12) United States Patent
Doehler

(10) Patent No.: US 6,368,261 B1
(45) Date of Patent: Apr. 9, 2002

(54) DESK CHAIR FOR THE PREVENTION OF REPETITIVE STRESS INJURIES

(76) Inventor: Steven John Doehler, 737 Tallwood Rd., Charleston, SC (US) 29412

( * ) Notice: Subject to any disclaimer, the term of this patent is extended or adjusted under 35 U.S.C. 154(b) by 0 days.

(21) Appl. No.: 09/629,517

(22) Filed: Aug. 1, 2000

Related U.S. Application Data

(63) Continuation of application No. 09/039,298, filed on Mar. 14, 1998, now abandoned.

(51) Int. Cl.[7] ..... A47C 3/00

(52) U.S. Cl. ..... 482/142; 297/408; 297/410

(58) Field of Search ..... 297/115–117, 292, 297/296, 299, 404, 408, 411.35, 411.33, 410, 411.32, 303.1; 482/121, 123, 129, 130, 133, 137, 904, 142

(56) References Cited

U.S. PATENT DOCUMENTS

| | | | | | |
|---|---|---|---|---|---|
| 376,886 | A | * | 1/1888 | Holden | |
| 877,274 | A | * | 1/1908 | Weber | |
| 2,869,622 | A | * | 1/1959 | Peterson | |
| 3,712,666 | A | * | 1/1973 | Stoll | 297/61 |
| 3,877,751 | A | * | 4/1975 | Rasmussen | 297/410 |
| 4,277,102 | A | * | 7/1981 | Aaras | 297/411 |
| 4,335,920 | A | * | 6/1982 | Hirth | 297/408 |
| 4,362,335 | A | * | 12/1982 | Drabert | 297/300 |
| 4,863,218 | A | * | 9/1989 | McCrackin | 297/39.1 |
| 5,110,121 | A | * | 5/1992 | Foster | 482/137 |
| 5,143,422 | A | * | 9/1992 | Althofer | 297/411 |
| 5,275,465 | A | * | 1/1994 | Gulliver | 297/173 |
| 5,681,079 | A | * | 10/1997 | Robinson | 297/61 |
| 5,730,688 | A | * | 3/1998 | Prusick | 482/130 |
| 5,755,650 | A | * | 5/1998 | Urso | 482/138 |
| 5,839,786 | A | * | 11/1998 | Cvek | 297/411.35 |

* cited by examiner

*Primary Examiner*—Glenn E. Richman
(74) *Attorney, Agent, or Firm*—Woodard, Emhardt, Naughton, Moriarty & McNett

(57) ABSTRACT

A desk chair has a sitting component, a headrest component adjoined to the sitting component and rotational relative to the sitting component, and a left armrest component and a right armrest component both adjoined to the sitting component and rotational relative to the sitting component. The sitting component seats a user of the desk chair and includes a reclining mechanism to enable a user to perform stretching and strengthening exercises for the abdomen of the user. The headrest component supports the head of a user of the desk chair and enables the user to perform stretching and strengthening exercises for the neck of the user. The left armrest component and the right armrest component support the arms of the user of the desk chair and enable the user to perform stretching and strengthening exercises for the chest, back, shoulders, arms and/or abdomen of the user. The user can also utilize the reclining mechanism to increase or decrease the range of motion of an exercise for the user.

20 Claims, 9 Drawing Sheets

DESK CHAIR FOR THE PREVENTION OF REPETITIVE STRESS INJURIES

REFERENCE TO RELATED APPLICATIONS

This application is a continuation of Ser. No. 09/039,298, filed Mar. 14, 1998, now abandoned.

FIELD OF THE INVENTION

The present invention generally relates to desk chairs and more specifically, to desk chairs designed to enable users of computers, typewriters, etc. to perform stretching and strengthening exercises that prevent the occurrence of repetitive stress injuries.

BACKGROUND OF THE INVENTION

With the office environment becoming dominated by computers, typewriters, etc., today's office worker is facing everyday tasks that involve sedentary postures coupled with repetitive motions such as keying. Consequently, office workers can experience a repetitive stress injury that decreases their productivity and possibly forces them to give up their careers. In response to the rising occurrence of repetitive stress injuries, the office furniture industry has made advancements in office ergonomics. However, such advancements have failed to properly integrate physical movements into office furniture that can eliminate the occurrence of repetitive stress injuries. What is therefore needed is some type of office furniture that effectively and conveniently integrates physical movements into the daily routine of office workers to prevent repetitive stress injuries.

SUMMARY OF THE INVENTION

The present invention overcomes the aforementioned drawbacks associated with current office furniture. Various aspects of the present invention are novel, non-obvious, and provide various advantages. While the actual nature of the present invention described in detail herein can only be determined with reference to the claims appended hereto, certain features which are characteristic of the present invention disclosed herein can be described briefly.

In accordance with a first aspect of the present invention, a desk chair for the prevention of repetitive stress injuries comprises a sitting component having a side surface, and a headrest component coupled to the sitting component. The headrest component is rotational about an axis that intersects a plane bounded by a portion of the side surface of the sitting component.

In accordance with a second aspect of the present invention, a desk chair for the prevention of repetitive stress injuries comprises a sitting component having a side surface, and an armrest component coupled to the sitting component. The armrest component is rotational about an axis that intersects a plane bounded by a portion of the side surface of the sitting component.

It is an object of the present invention to effectively and conveniently integrate stretching and strengthening exercises for all of the major muscles in the upper body of a person into a desk chair. This and other advantages of the present invention will become more apparent from the following description of the preferred embodiment.

DESCRIPTION OF THE PREFERRED EMBODIMENT

Figure 1A:
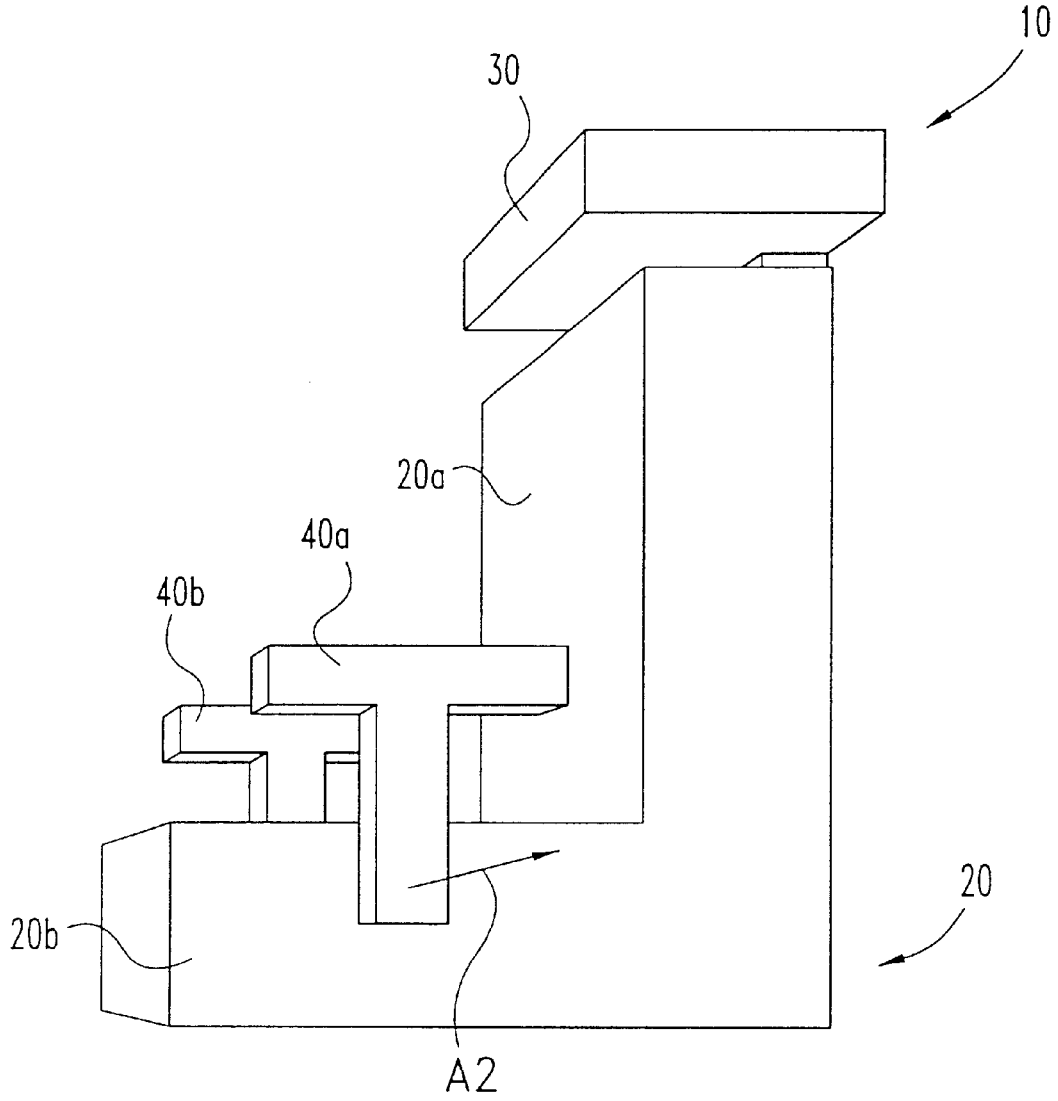
FIG. 1A is a front perspective view of a left side of a schematic diagram of a desk chair 10 in accordance with the present invention.

For the purposes of promoting an understanding of the principles of the present invention, reference will now be made to the embodiment illustrated in the drawings and specific language will be used to describe the same. It will nevertheless be understood that no limitation of the scope of the present invention is thereby intended, such alterations and further modifications in the illustrated embodiment, and such further applications of the principles of the present invention as illustrated therein being contemplated as would normally occur to one skilled in the art to which the present invention relates.

Figure 1B:
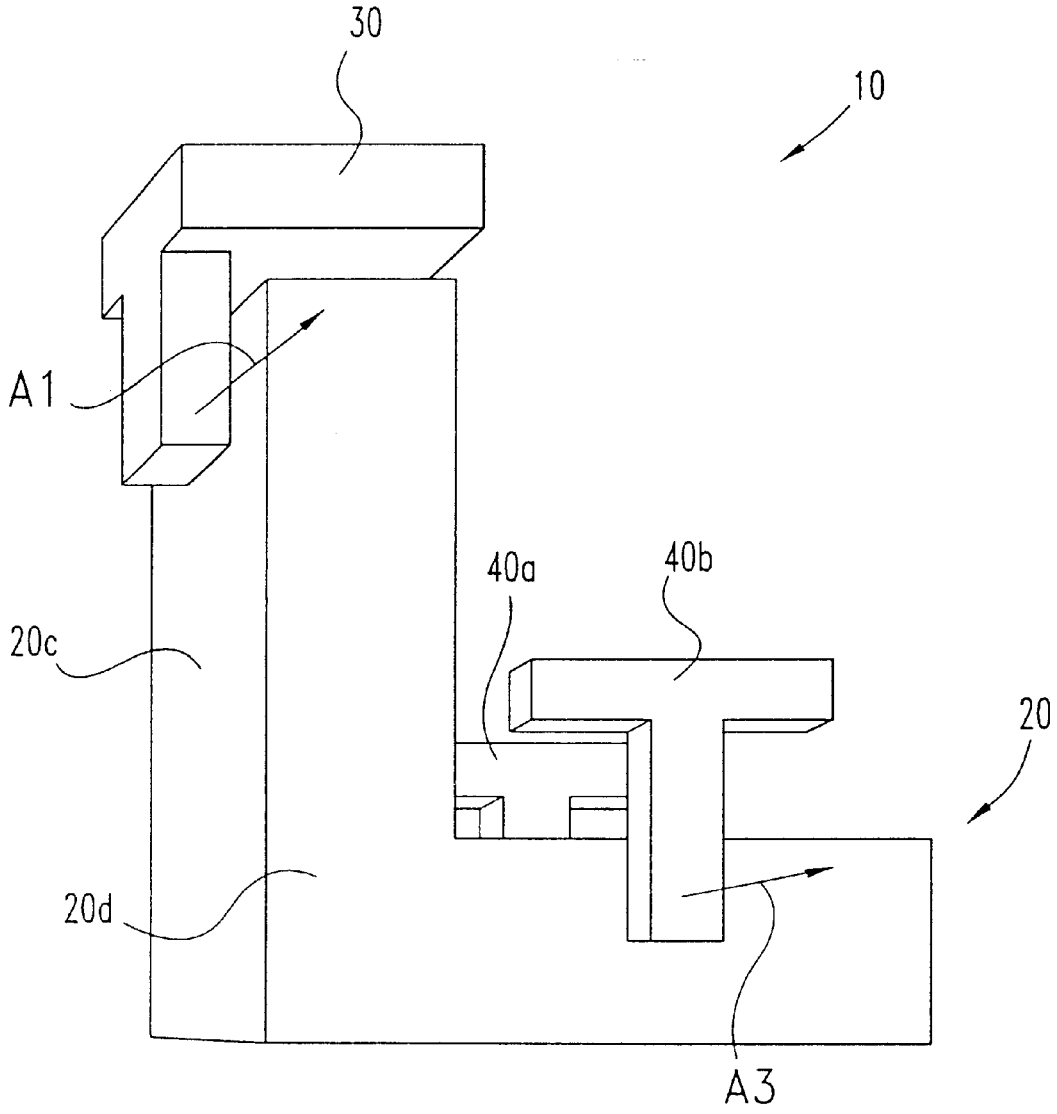
FIG. 1B is a rear perspective view of a right side of desk chair 10 in FIG. 1A.

FIGS. 1A and 1B are a front perspective view of a left side, and a rear perspective view of a right side, respectively, of a schematic diagram of a desk chair 10 in accordance with the present invention. Referring to FIGS. 1A and 1B, desk chair 10 comprises a sitting component 20 having a front side surface 20*a*, a left side surface 20*b* bordering front side surface 20*a*, a rear side surface 20*c* bordering left side surface 20*b*, a right side surface 20*d* bordering front side surface 20*a* and rear side surface 20*c*, and a top side surface 20*e* (not shown) bordering front side surface 20*a*, left side surface 20*b*, rear side surface 20*c*, and right side surface 20*d*. For purposes of the present invention, sitting component 20 is broadly defined as any article of manufacture or any combination of articles to seat a user of desk chair 10.

Figure 2A:
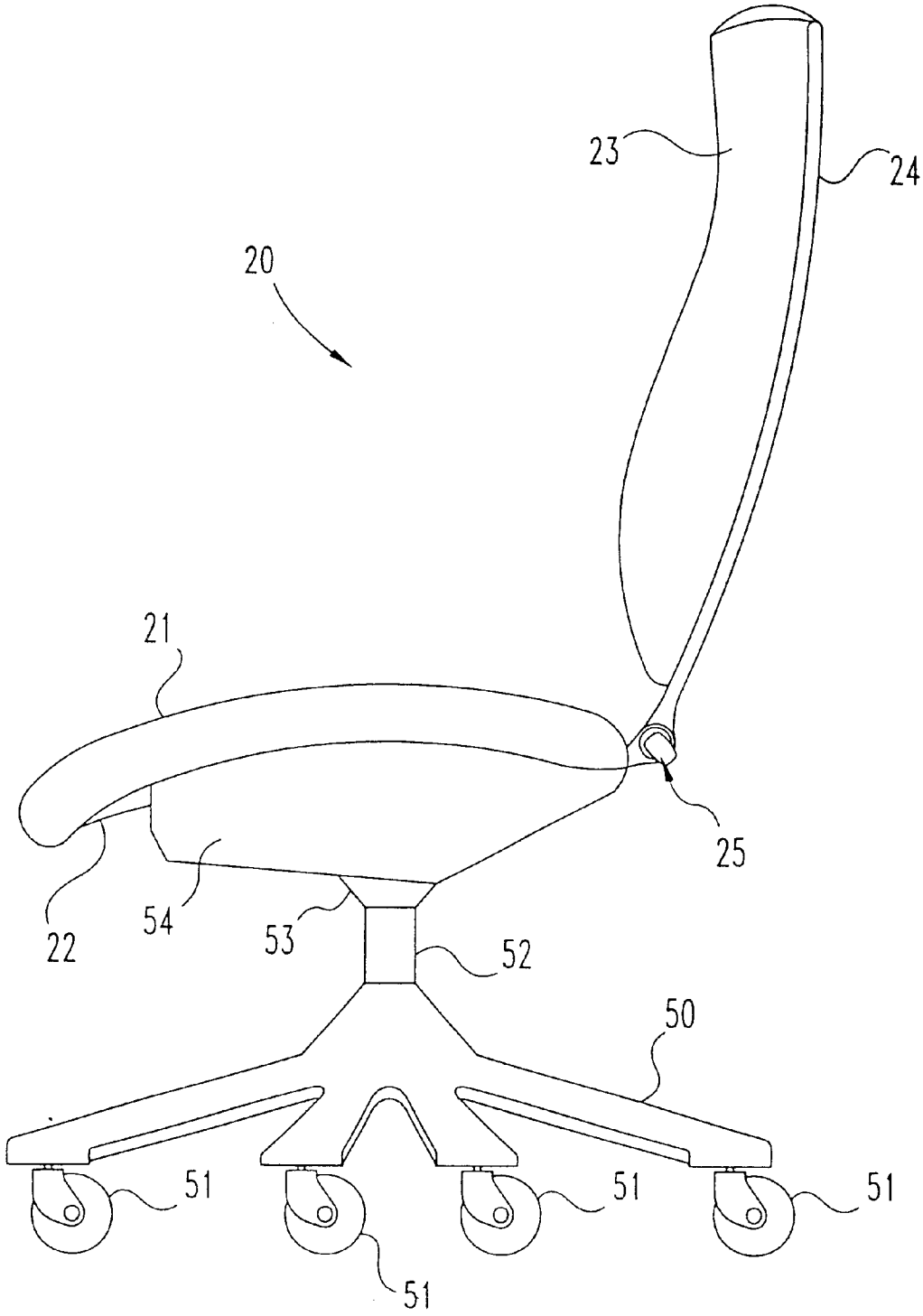
FIG. 2A is a left side view of a preferred embodiment of a sitting component 20 in FIGS. 1A and 1B.

FIG. 2A is a left side view of a preferred embodiment of sitting component 20. Referring to FIG. 2A, the preferred embodiment of sitting component 20 includes a seat cushion 21, a hinged seat pan 22 adjoined to a bottom surface of seat cushion 21, a back cushion 23, a backrest pan 24 adjoined to a rear surface of back cushion 23, and a reclining mechanism 25 adjoined to backrest pan 24 and hinged seat pan 22. For purposes of the present invention, seat cushion 21 is broadly defined as any article of manufacture or any combination of articles to engage the lower torso and the rear side of the upper legs of a user of desk chair 10, hinged seat pan 22 is broadly defined as any article of manufacture or any combination of articles to provide support to seat cushion 21, back cushion 23 is broadly defined as any article of manufacture or any combination of articles to engage the back of a user of desk chair 10, backrest pan 24 is broadly defined as any article of manufacture or any combination of articles to provide support to back cushion 23, and reclining mechanism 25 is broadly defined as any article of manufacture or any combination of articles to enable a user of desk chair 10 to change the angular orientation of back cushion 23 relative to seat cushion 21. Also for purposes of the present invention, the term adjoined is broadly defined as the integration, permanent affixation or detachable coupling of a particular element or elements of desk chair 10 to another element or elements of desk chair 10.

Figure 2B:
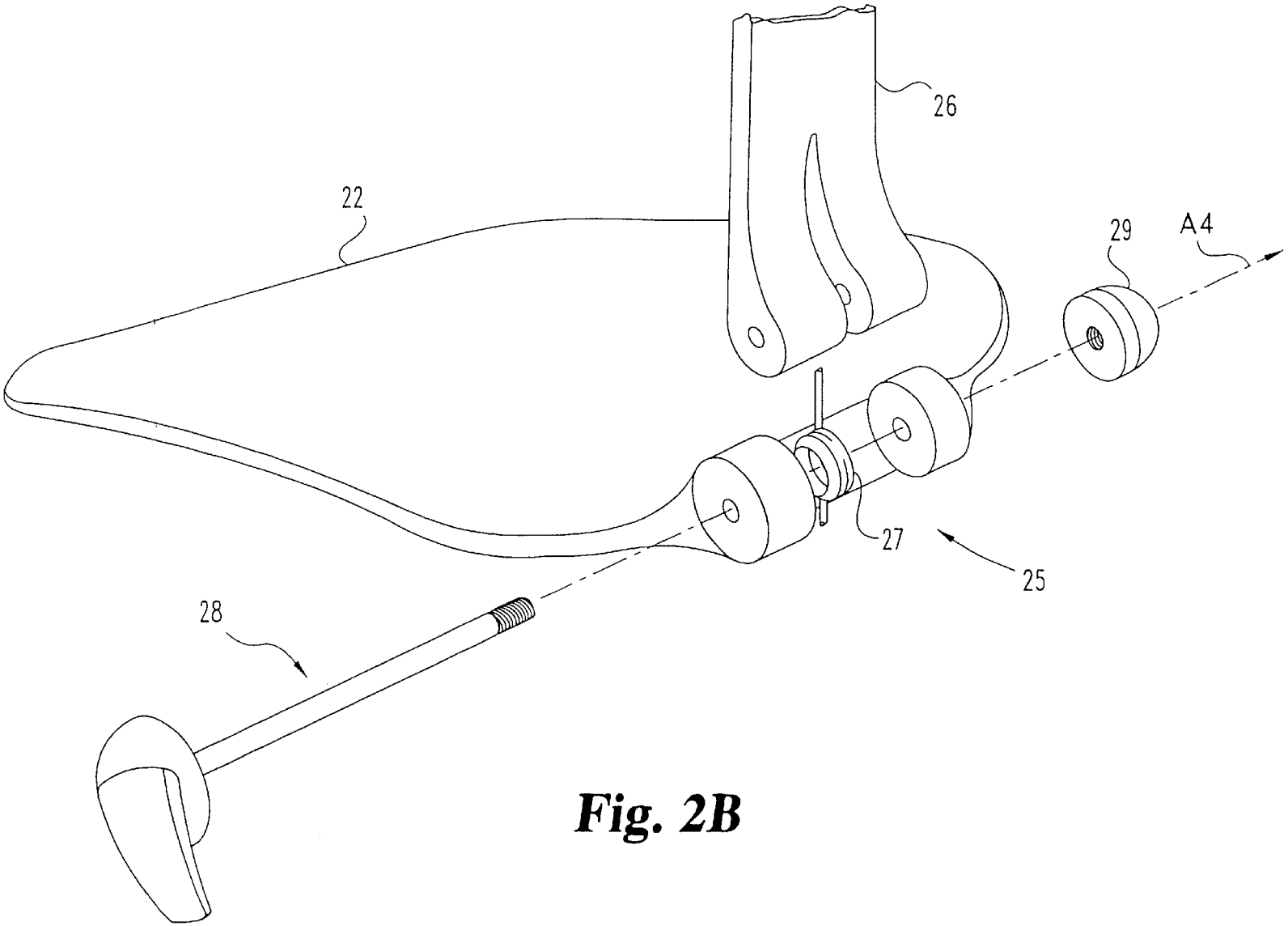
FIG. 2B is a rear perspective view of a left side of a preferred embodiment of a reclining mechanism 25 in FIG. 2A as disassembled.

FIG. 2B is a left side perspective view of the preferred embodiment of reclining mechanism 25 as disassembled. Referring to FIG. 2B, the preferred embodiment of reclining mechanism 25 includes a hinged connector 26 to be mated with hinged seat pan 22 and to be adjoined to backrest pan 24 (not shown in FIG. 2B), a spring 27 to be disposed within the mating of hinged seat pan 22 and hinged connector 26, a cam rod 28 to be inserted through hinged seat pan 22, hinged connector 26 and spring 27, and a threaded cap 29 to be screwed on cam rod 28. It is to be appreciated and understood that a user of desk chair 10 can utilize cam rod 28 to change the angular orientation of back cushion 23 relative to seat cushion 21 by rotating back cushion 23 about an axis A4. It is to be further appreciated and understood that spring 27 bias back cushion 23 towards seat cushion 21.

Referring again to FIG. 2A, the present invention contemplates desk chair 10 can further comprise a base 50, a plurality of casters 51 adjoined to base 50, a spring mechanism 52 adjoined to base 50, a tilt mechanism 53 adjoined to a bottom surface of hinged seat pan 22 and to spring mechanism 52, and a cover 54 disposed on hinged seat pan 22 and over a top portion of tilt mechanism 53. For purposes of the present invention, base 50 is broadly defined as any article of manufacture or any combination of articles to provide a stable support for the weight of a user of desk chair 10, casters 51 are broadly defined as any articles of manufacture or any combination of articles to enable a user of desk chair 10 to roll desk chair 10 throughout a work or living environment, spring mechanism 52 is broadly defined as any article of manufacture or any combination of articles to enable a user of desk chair 10 to adjust the sitting height of seat cushion 21, and tilt mechanism 53 is broadly defined as any article of manufacture or any combination of articles to enable a user of desk chair 10 to adjust the angular orientation of seat cushion 21 relative to base 50. It is to be appreciated and understood that the adjoining of backrest pan 24 and hinged seat pan 22 via reclining mechanism 25 enables the vertical and angular movement of back cushion 23 to coincide with the vertical and angular movement of seat cushion 21 via spring mechanism 52 and tilt mechanism 53.

Referring again to FIGS. 1A and 1B, desk chair 10 further comprises a headrest component 30 adjoined to either left side surface 20*b*, rear side surface 20*c* (as shown in FIGS. 1A and 1B), right side surface 20*d* and/or top side surface 20*e* of sitting component 20 in a manner that permits the rotation of headrest component 30 about an axis A1 that intersects a plane bounded by any portion of left side surface 20*b* of sitting component 20 and a plane bounded by any portion of right side surface 20*d* of sitting component 20. For purposes of the present invention, headrest component 30 is broadly defined as any article of manufacture or any combination of articles to support the head and neck of a user of desk chair 10. The present invention contemplates that left side surface 20*b* and right side surface 20*d* can vary in three-dimensional shape and dimensions. The present invention further contemplates that axis A1 may or may not be perpendicular to either left side surface 20*b*, right side surface 20*d* or both. Preferably, left side surface 20*b* and right side surface 20*d* are substantially flat, and axis A1 is perpendicular to left side surface 20*b* and right side surface 20*d*.

Figure 3A:
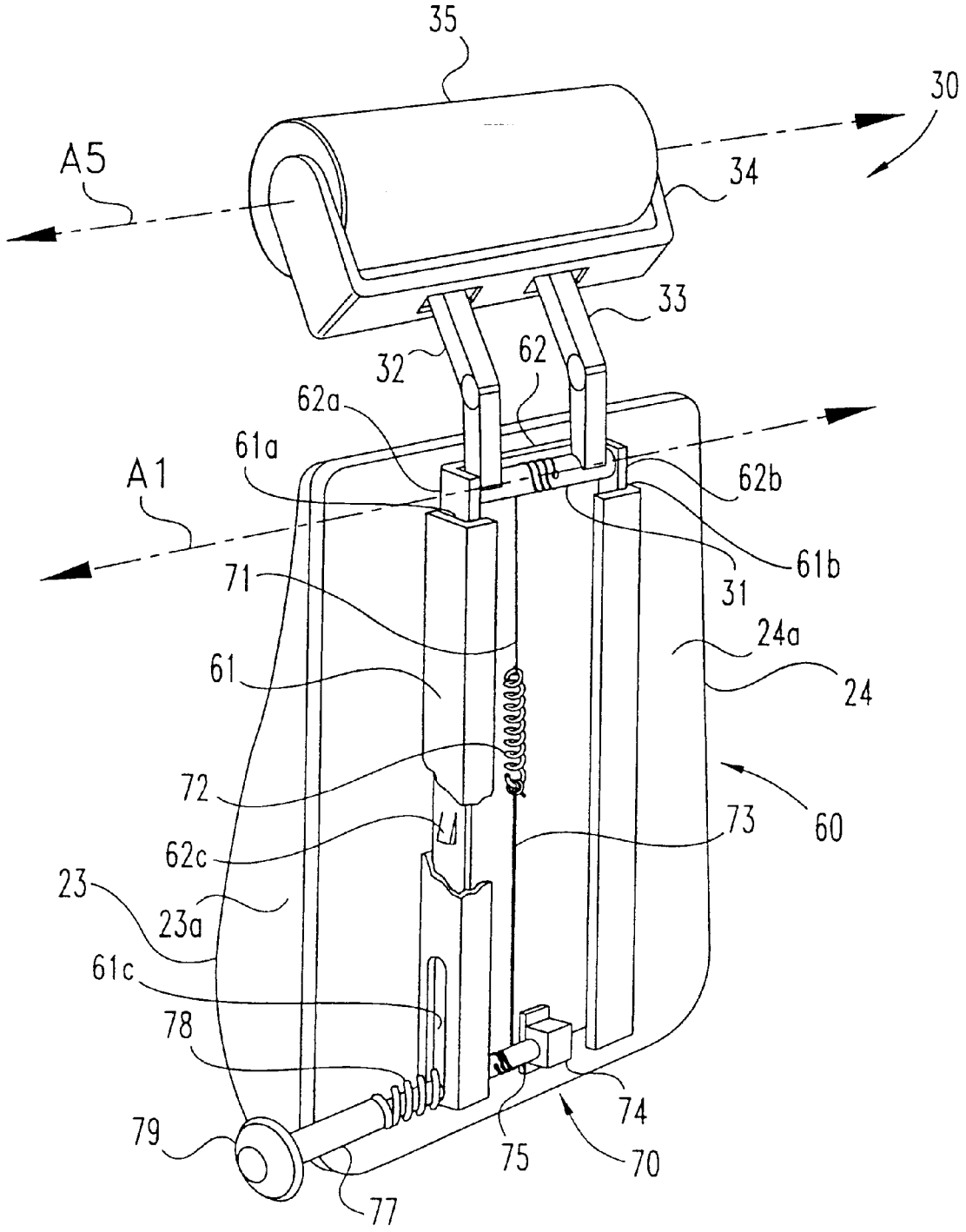
FIG. 3A is a rear perspective view of a left side of a preferred embodiment of a headrest component 30 in FIGS. 1A and 1B.

FIG. 3A is a left side perspective view of a preferred embodiment of headrest component 30 in accordance with the present invention. Referring to FIG. 3A, the preferred embodiment of headrest component 30 includes a rod 31 adjoined to a rear surface 24*a* of backrest pan 24 in a manner that permits rod 31 to rotate about the longitudinal axis of rod 31. For purposes of the preferred embodiment of headrest component 30, rear surface 24*a* of backrest pan 24 corresponds to rear surface 20*c* of sitting component 20 in FIG. 1B, and the longitudinal axis of rod 31 corresponds to axis A1 in FIG. 1B. The preferred embodiment of headrest component 30 further includes a first ratchet arm 32 adjoined to rod 31, a second ratchet arm 33 adjoined to rod 31, a bracket 34 adjoined to first ratchet arm 32 and second ratchet arm 33, and a pad 35 adjoined to bracket 34. For purposes of the present invention, first ratchet arm 32 and second ratchet arm 33 are broadly defined as any article of manufacture or any combination of articles to bias pad 35 towards the head of a user of desk chair 10. The present invention contemplates that pad 35 can vary in geometric shape. Preferably, as shown in FIG. 3A, pad 35 is cylindrical. The present invention further contemplates that either pad 35 is adjoined to bracket 34 in a manner that inhibits the rotation of pad 35 about a longitudinal axis A5 of pad 35 or preferably, is adjoined to bracket 34 in a manner that permits the rotation of pad 35 about longitudinal axis A5.

Referring again to FIG. 3A, the present invention contemplates that rod 31 can be adjoined to rear surface 24*a* of backrest pan 24 in a manner that either inhibits or preferably, permits adjustments to the distance between back cushion 23 and pad 35. Accordingly, desk chair 10 can further comprise height adjustment mechanism 60. For purposes of the present invention, height adjustment mechanism 60 is broadly defined as any article of manufacture or any combination of articles to permit adjustments to the distance between back cushion 23 and pad 35. The preferred embodiment of height adjustment mechanism 60 includes a channel 61 coupled to rear surface 24*a* of backrest pan 24. Channel 61 has a groove 61*a* and a groove 61*b* opposing groove 61*a*. The preferred embodiment of height adjustment mechanism 60 further includes a beam 62 having a first arm 62*a* disposed within groove 61*a*, a second arm 62*b* disposed within groove 61*b*, a first locking tab 62*c* disposed on first arm 62*a* and engaging groove 61*a*, and a second locking tab 62*d* (not shown in FIG. 3A) disposed on second arm 62*b* and engaging groove 61*b*.

Still referring to FIG. 3A, the present invention contemplates that the initial amount of force required by the user of desk chair 10 against pad 35 to start the rotation of rod 31 about longitudinal axis A1 can be fixed or preferably, adjustable. The present invention further contemplates that the subsequent amount of force required to continually rotate rod 31 about longitudinal axis A1 can either be constant or preferably, progressive. Accordingly, desk chair 10 can further comprise a counterforce generating mechanism 70. For purposes of the present invention, counterforce generating mechanism 70 is broadly defined as any article of manufacture or any combination of articles to provide a progressive counterforce to any force applied to pad 35 to rotate rod 31 about axis A1.

Figure 3B:
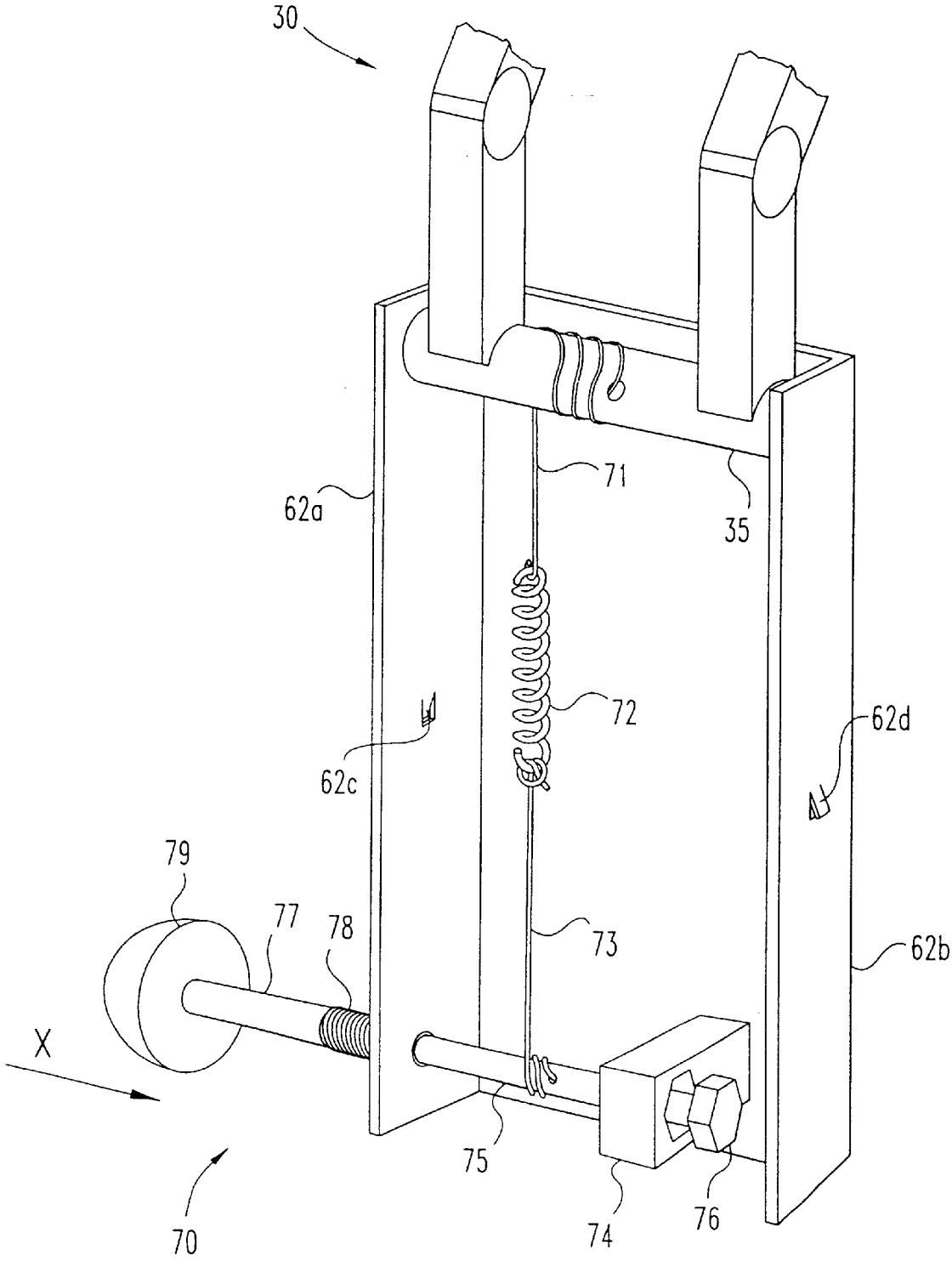
FIG. 3B is a fragmented rear perspective view of a right side of headrest component 30 in FIG. 3A.

FIG. 3B is a fragmented right perspective view of a rear side of a preferred embodiment of counterforce generating mechanism 70. Referring to FIGS. 3A and 3B, the preferred embodiment of counterforce generating mechanism 70 includes a first cable 71 adjoined to rod 31 in a manner that permits first cable 71 to be wrapped around and unwrapped from rod 31, a spring 72 adjoined to first cable 71, a second cable 73 adjoined to spring 72, a bracket 74 adjoined to beam 62, and a rod 75 adjoined to second cable 73 in a manner that enables second cable 73 to be wrapped around and unwrapped from rod 75. Rod 75 is also slidably disposed within bracket 74, an aperture 62*e* of beam 62, and a slot 61*c* of channel 61. The preferred embodiment of counterforce generating mechanism 70 further includes a hexagon-shaped nut 76 adjoined to rod 75 to engage bracket 74, a rod 77 having a larger radius than rod 75 and adjoined to rod 75 and opposing hexagon-shaped nut 76, a spring 78 disposed on rod 75 between rod 77 and beam 62, and a knob 79 adjoined to rod 77 and opposing rod 75. It is to be appreciated and understood that the tension along spring 72 provides an initial counterforce for any initial force applied to pad 35 as well as provides a progressive counterforce for any subsequent force applied to pad 35. It is to be further appreciated and understood that, in order to adjust the tension along spring 72 prior to applying a force against pad 35, a user of desk chair 10 pushes knob 79 in the X direction to disengage hexagon-shaped nut 76 from bracket 74, turns knob 79 accordingly, and releases knob 79 in order to re-engage hexagon-shaped nut 76 with bracket 74.

Again referring to FIGS. 1A and 1B, desk chair 10 further comprises a left armrest component 40*a* adjoined to either front side surface 20*a*, left side surface 20*b* (as shown in FIGS. 1A and 1B), rear side surface 20*c*, and/or top side surface 20*e* of sitting component 20 in a manner that permits the rotation of left armrest component 40*a* about an axis A2 that intersects a plane bounded by any portion of left side surface 20*b*, and a right armrest component 40*b* adjoined to either front side surface 20*a*, rear side surface 20*c*, right side surface 20*d* (as shown in FIGS. 1A and 1B) and/or top side surface 20*e* of sitting component 20 in a manner that permits the rotation of right armrest component 40*b* about an axis A3 that intersects a plane bounded by any portion of right side surface 20*d*. For purposes of the present invention, left armrest component 40*a* and right armrest component 40*b* are broadly defined as any article of manufacture or any combination of articles to support the left arm and the right arm, respectively, of a user of desk chair 10. The present invention contemplates that axis A1, axis A2 and axis A3 may or may not be parallel. The present invention further contemplates that axis A2 and axis A3 may or may not be perpendicular to a substantial portion of left side surface 20*b* and right side surface 20*d*, respectively. The present invention also contemplates that axis A2 and axis A3 may or may not coincide. Preferably, axis A1, axis A2 and axis A3 are parallel, axis A2 and axis A3 are perpendicular to a substantial portion of left side surface 20*b* and right side surface 20*d*, respectively, and axis A2 coincides with axis A3.

Figure 4A:
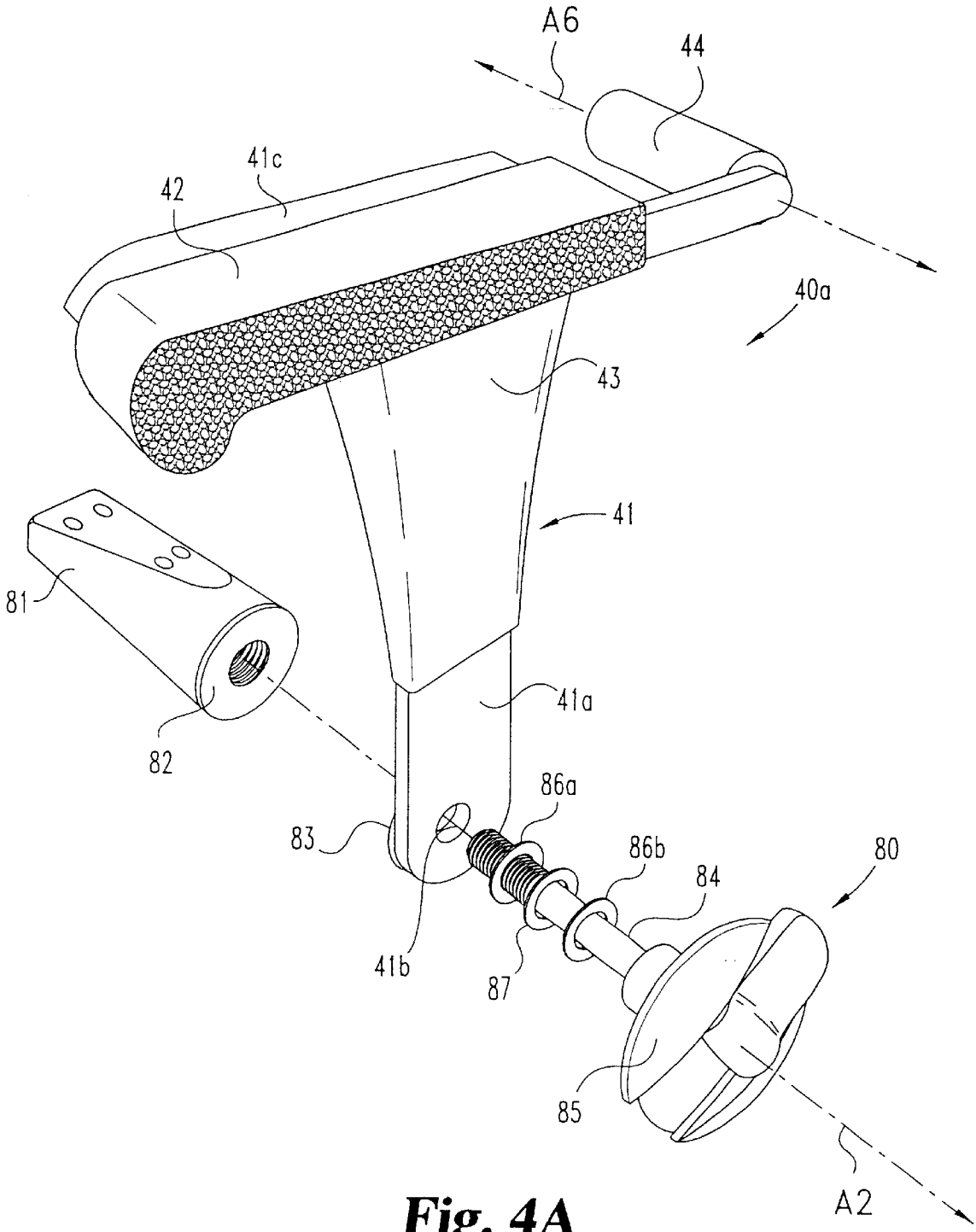
FIG. 4A is a front perspective view of a left side of a preferred embodiment of a left armrest component 40*a* in FIGS. 1A and 1B.
Figure 4B:
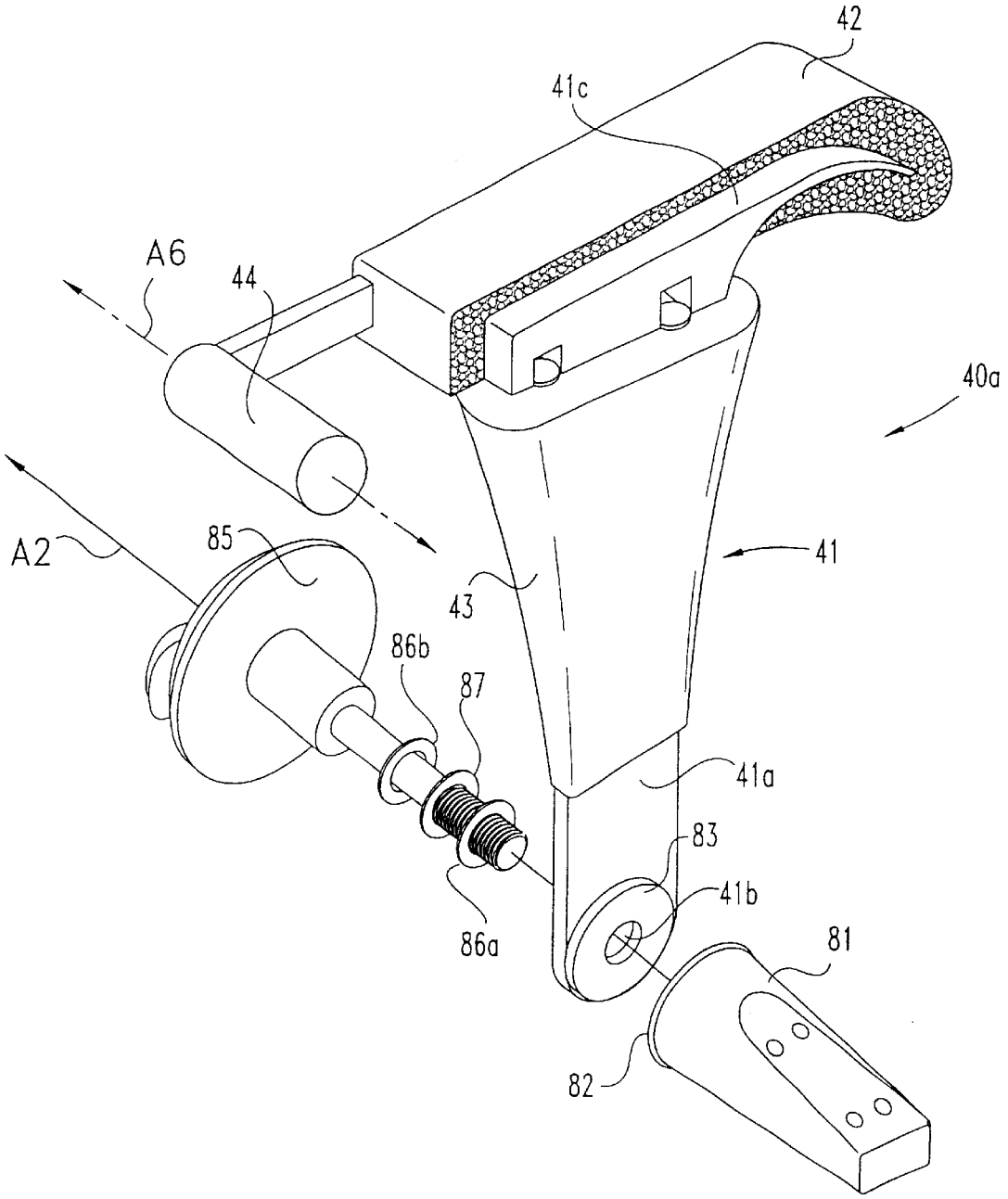
FIG. 4B is a rear perspective view of a right side of left armrest component 40*a* in of FIG. 4A.

FIGS. 4A and 4B are a front perspective view and a rear perspective view, respectively, of a preferred embodiment of left armrest component 40*a*. Referring to FIGS. 4A and 4B, the preferred embodiment of left armrest component 40*a* includes a support arm 41 to be coupled to a bottom surface of hinged seat pan 22 (not shown in FIGS. 4A and 4B) in a manner than enables left armrest component 40*a* to be rotated about axis A2. Support arm 41 has a base 41*a*, an aperture 41*b* disposed in a lower end of base 41*a* and an platform 41*c* extending from a top end of base 41*a*. The preferred embodiment of left armrest component 40*a* further includes a first cushion 42 disposed on platform 41*c*, a cover 43 disposed around base 41*a* without obstructing aperture 41*b*, and a handle 44 adjoined to and extending away from platform 41*c*. Handle 44 is fully rotational about a longitudinal axis A6 of handle 44. For purposes of the preferred embodiment of left armrest component 40*a*, the longitudinal axis of aperture 41*b* corresponds with axis A2 in FIG. 1. It is to be appreciated and understood that a user of desk chair 10 can utilize either platform 41*c* or handle 44 to rotate left armrest component 40*a* about axis A2. Please note that the preferred embodiment of right armrest component 40*b* is the reciprocal of the preferred embodiment of left armrest component 40*a* as described herein.

Still referring to FIGS. 4A and 4B, the present invention contemplates that the amount of force required by the user of desk chair 10 to start the rotation of left armrest component 40*a* about axis A2 can be adjusted. Accordingly, the present invention includes a tension adjusting mechanism 80. For purposes of the present invention, tension adjusting mechanism 80 is broadly defined as any article of manufacture or any combination of articles of manufacture to adjust the force necessary to rotate left armrest component 40*a* about axis A2. The preferred embodiment of tension adjusting mechanism 80 as disassembled includes a mounting bracket 81 to be adjoined to hinged seat pan 22 (not shown in FIGS. 4A and 4B), a steel plate 82 adjoined to mounting bracket 81, a self-lubricating pad 83 adhered to base 41*a* and to be disposed between steel plate 82 and base 4la, and a threaded rod 84 to be disposed within aperture 41*b*, self-lubricating pad 83 and steel plate 82, and to be screwed into mounting bracket 81. The preferred embodiment of tension adjusting mechanism 80 further includes a cam knob 85 adjoined to threaded rod 84 and opposing mounting bracket 81, a pair of washers 86*a* and 86*b* disposed on threaded rod 84 between base 41*a* and cam knob 85, and a thruster bearing 87 disposed on threaded rod 84 between washer 86*a* and washer 86*b*. It is to be appreciated and understood that self-lubricating pad 83 provides a counterforce to any force applied to left armrest component 40*a* in order to rotate left armrest component 40*a* about axis A2. It is to be further appreciated and understood that a user of desk chair 10 can adjust the degree of counterforce by unlocking cam knob 85, rotating cam knob 85 accordingly, and locking cam knob 85. It is to be further appreciated and understood that a user of desk chair 10 can customize the support provided to the left arm of the user by utilizing tension adjusting mechanism 80 to lock left armrest component 40*a* in a desired angular orientation relative to axis A2.

Figure 5:
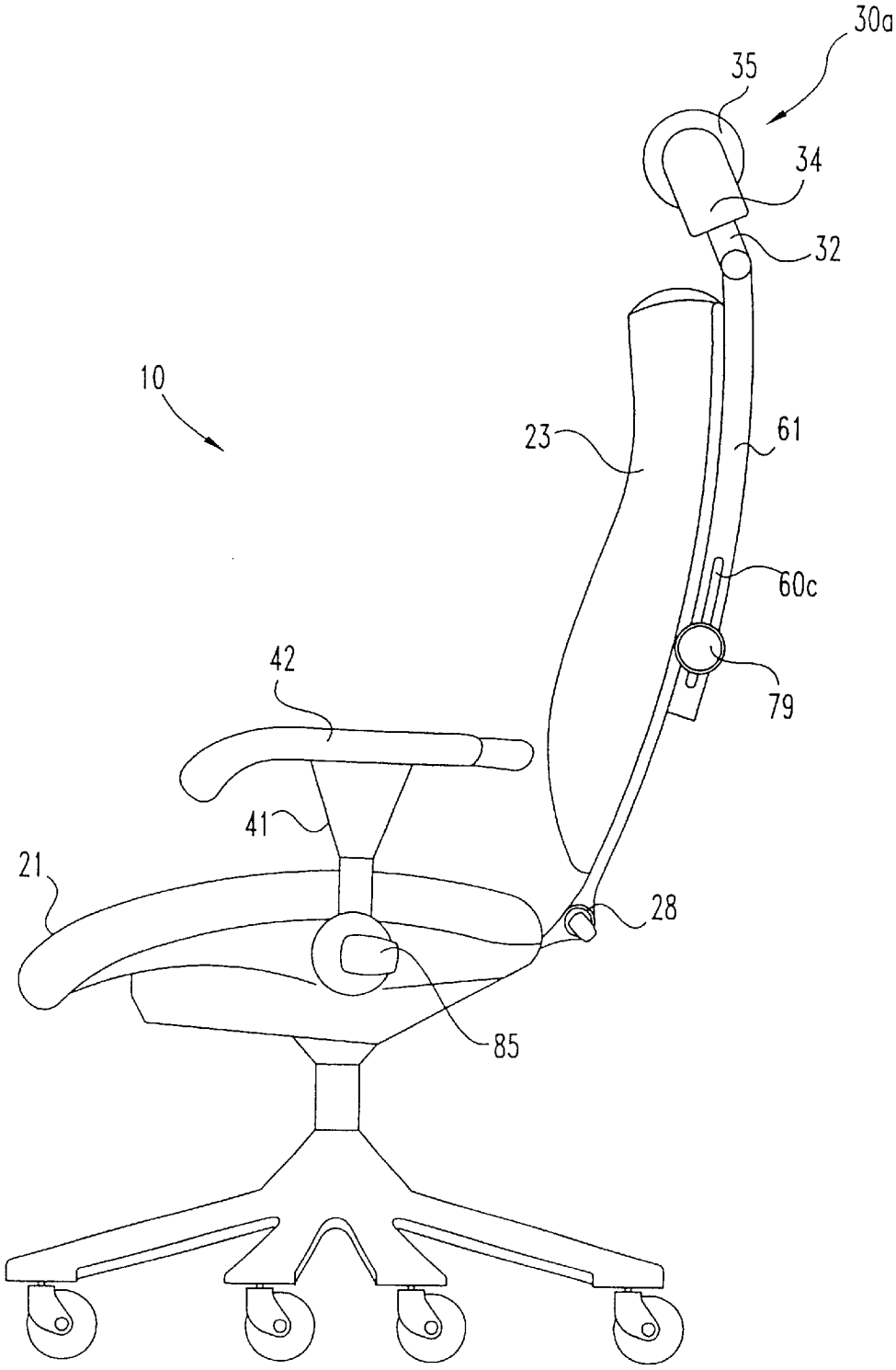
FIG. 5 is a left side view of a preferred embodiment of desk chair 10 in FIGS. 1A and 1B.

FIG. 5 is a left side view of a preferred embodiment of desk chair 10. Referring to FIGS. 1A, 1B, and 5, it is to be appreciated and understood that a variety of exercises to prevent the occurrence of repetitive stress injures can be preformed by a user of the preferred embodiment of desk chair 10. First, by rotating headrest component 30*a* about axis A1 as shown in FIG. 3A, a user of the preferred embodiment of desk chair 10 can perform an exercise to stretch and strengthen a variety of neck muscles of the user, and by rotating pad 35 about axis A4 as shown in FIG. 3A, the user can perform an exercise to stretch and strengthen an upper portion of the neck of the user. Second, by rotating the preferred embodiments of left armrest component 40*a* and right armrest component 40*b* about axis A2 and axis A3, respectively, a user of the preferred embodiment of desk chair 10 can perform a variety of exercises to stretch and strengthen the chest, back, shoulders, arms, and/or abdomen of the user. Finally, by squeezing cushion 42 or rotating handle 44 about longitudinal axis A6 as shown in FIGS. 4A and 4B, a user of the preferred embodiment of desk chair 10 can perform an exercise to stretch and strengthen the hands and the wrist of the user. It is to be further appreciated and understood that, by changing the angular orientation of back cushion 23 relative to seat cushion 21, a user of the preferred embodiment of desk chair 10 can vary the range of motion of the upper body exercises as well as perform additional exercises to stretch and strengthen the abdomen of the user.

While the present invention has been illustrated and described in detail in the drawings and foregoing description, the same is to be considered as illustrative and not restrictive in character, it being understood that the preferred embodiment has been shown and described and that all changes and modifications that come within the spirit of the invention are desired to be protected.

What is claimed is:

1. A desk chair, comprising:

a sitting component to seat a user of said desk chair, said sitting component having a side surface;

a headrest component to support a head of the user of said desk chair, said headrest component rotatably adjoined to said sitting component, said headrest component being rotatable in a first direction and in a second direction about a first axis intersecting a plane bounded by a portion of said side surface of said sitting component, wherein said headrest component is biased in said first direction.

2. The desk chair of claim 1 wherein said headrest component includes:

a rod rotatable in said first direction and in said second direction about a longitudinal axis of said rod, said rod being biased in said first direction, said longitudinal axis of said rod intersecting said plane to thereby function as said first axis;

a pad to support the head of the user, said pad adjoined to said rod; and a height adjustment mechanism operable to adjust a distance between said paid and said sitting component.

3. The desk chair of claim 1 wherein said headrest component includes:

a rod rotatable in said first direction and in said second direction about a longitudinal axis of said rod, said rod being biased in said first direction, said longitudinal axis of said rod intersecting said plane to thereby function as said first axis;

a pad to support the head of the user, said pad adjoined to said rod; and a means for adjusting a distance between said pad and said sitting component.

4. The desk chair of claim 1 wherein said headrest component includes:

a rod rotatable in said first direction and in said second direction about a longitudinal axis of said rod, said rod being biased in said first direction, said longitudinal axis of said rod intersecting said plane to thereby function as said first axis;

a pad to support the head of the user, said pad adjoined to said; and a counterforce generating mechanism operable to provide a counterforce to any force applied to said pad to rotate said rod in said second direction about said longitudinal axis.

5. The desk chair of claim 1 wherein said headrest component includes:

a rod rotatable in said first direction and in said second direction about a longitudinal axis of said rod, said rod being biased in said first direction, said longitudinal axis of said rod intersecting said plane to thereby function as said first axis;

a pad to support the head of the user, said pad adjoined to said rod; and a means for providing a counterforce to any force applied to said pad to rotate said rod in said second direction about said longitudinal axis of said rod.

6. The desk chair of claim 1 further comprising:

an armrest component to support an arm of the user of said desk chair, said armrest component rotatably adjoined to said sitting component, said armrest component being rotatable in a third direction and in a fourth direction about a second axis intersecting a plane bounded by said portion of said side surface of said sitting component.

7. The desk chair of claim 6 wherein said armrest component includes:

a support arm operable to be rotated in said third direction and in said fourth direction about said second axis; and a tension adjusting mechanism operable to provide a first counterforce to any force applied to said support arm to rotate said support arm in said third direction and a second counterforce to any force applied to said support arm to rotate said support arm in said fourth direction.

8. The desk chair of claim 6 wherein said armrest component includes:

a support arm operable to be rotated in said third direction and in said fourth direction about said second axis; and a means for providing a first counterforce to any force applied to said support arm to rotate said support arm in said third direction and a second counterforce to any force applied to said support arm to rotate said support arm in said fourth direction.

9. The desk chair of claim 1 wherein said sitting component includes:

a seat cushion;

a back cushion disposable in at least two angular positions relative to said seat cushion; and a reclining mechanism operable to dispose said back cushion in a first angular position of said at least two angular positions.

10. The desk chair of claim 1 wherein said sitting component includes:

a seat cushion;

a back cushion disposable in at least two angular positions relative to said seat cushion; and a means for disposing said back cushion in a first angular position of said at least two angular positions.

11. A desk chair, comprising:

a sitting component to seat a user of said desk chair, said sitting component having a side surface; and an armrest component to support an arm of the user of said desk chair, said armrest component rotatably adjoined to said sitting component, said armrest component being rotatable in a first direction and in a second direction about a first axis intersecting a plane bounded by a portion of said side surface of said sitting component, wherein said armrest component includes a tension adjusting mechanism operable to provide a first counterforce to any force applied to said armrest component to rotate said armrest component in said first direction and a second counterforce to any force applied to said armrest component to rotate said armrest component in said second direction.

12. The desk chair of claim 11 wherein said first counterforce and said second counterforce vary between a first level and a second level, said first level for maintaining said armrest component in a first position whereby the user of said desk chair is able to rotate said armrest component in either said first direction or said second direction, said second level for locking said armrest component in said first position whereby the user of said desk chair is prohibited from rotating said armrest component in either said first direction or said second direction.

13. The desk chair of claim 11 wherein said armrest component further includes:

a support arm; and a cushion adjoined to said support arm, said cushion operable to be squeezed by the user of said desk chair.

14. The desk chair of claim 11 wherein said armrest component further includes:

a support arm; and a handle rotatably adjoined to said support arm.

15. The desk chair of claim 11 wherein said sitting component includes:

a seat cushion;

a back cushion disposable in at least two angular positions relative to said seat cushion; and a reclining mechanism operable to dispose said back cushion in a first angular position of said at least two angular positions.

16. A desk chair, comprising:

a sitting component to seat a user of said desk chair, said sitting component having a side surface; and an armrest component to support an arm of the user of said desk chair, said armrest component rotatably adjoined to said sitting component, said armrest component being rotatable in a first direction and in a second direction about a first axis intersecting a plane bounded by a portion of said side surface of said sitting component, wherein said armrest component includes a means for providing a first counterforce to any force applied to said armrest component to rotate said armrest component in said first direction and a second counterforce to any force applied to said armrest component to rotate said armrest component in said second direction.

17. The desk chair of claim 16 wherein said first counterforce and said second counterforce vary between a first level and a second level, said first level for maintaining said armrest component in a first position whereby the user of said desk chair is able to rotate said armrest component in either said first direction or said second direction, said second level for locking said armrest component in said first position whereby the user of said desk chair is prohibited from rotating said armrest component in either said first direction or said second direction.

18. The desk chair of claim 16 wherein said armrest component further includes:

a support arm; and a cushion adjoined to said support arm, said cushion operable to be squeezed by the user of said desk chair.

19. The desk chair of claim 16 wherein said armrest component further includes:

a support arm; and a handle rotatably adjoined to said support arm.

20. The desk chair of claim 16 wherein said sitting component includes:

a seat cushion;

a back cushion disposable in at least two angular positions relative to said seat cushion; and a reclining mechanism operable to dispose said back cushion in a first angular position of said at least two angular positions.

* * * * *

UNITED STATES PATENT AND TRADEMARK OFFICE

CERTIFICATE OF CORRECTION

PATENT NO. : 6,368,261 B1
DATED : April 9, 2002
INVENTOR(S) : Steven J. Doehler

It is certified that error appears in the above-identified patent and that said Letters Patent is hereby corrected as shown below:

Title page,
Subject to any disclaimer, the term of this patent is extended or adjusted under 35 U.S.C. 154(b), please delete "by 0 days" and add -- by 67 days --

Signed and Sealed this

Third Day of September, 2002

*Attest:*

*Attesting Officer*

JAMES E. ROGAN
*Director of the United States Patent and Trademark Office*